US011401704B2

(12) United States Patent
Wang et al.

(10) Patent No.: US 11,401,704 B2
(45) Date of Patent: Aug. 2, 2022

(54) ON-BASIN INSTALLATION DEVICE OF FAUCET

(71) Applicant: Xiamen Delmei Sanitary Ware Co., Ltd., Xiamen (CN)

(72) Inventors: Chunhua Wang, Xiamen (CN); Yongqiang Yan, Xiamen (CN)

(73) Assignee: Xiamen Delmei Sanitary Ware Co., Ltd., Xiamen (CN)

( * ) Notice: Subject to any disclaimer, the term of this patent is extended or adjusted under 35 U.S.C. 154(b) by 70 days.

(21) Appl. No.: 16/935,161

(22) Filed: Jul. 21, 2020

(65) Prior Publication Data

US 2021/0317642 A1 Oct. 14, 2021

(30) Foreign Application Priority Data

Apr. 14, 2020 (CN) ..... 202020548084.3

(51) Int. Cl.
*E03C 1/04* (2006.01)

(52) U.S. Cl.
CPC ..... *E03C 1/0401* (2013.01)

(58) Field of Classification Search
CPC ..... E03C 1/0401
See application file for complete search history.

(56) References Cited

U.S. PATENT DOCUMENTS

| | | | | |
|---|---|---|---|---|
| 852,220 | A * | 4/1907 | Cecil | E03C 1/0401 285/193 |
| 9,376,791 | B2 * | 6/2016 | Wilkerson | E03C 1/0401 |
| 2018/0195628 | A1 * | 7/2018 | Tasserit | F16K 11/18 |
| 2019/0284785 | A1 * | 9/2019 | Mu | E03C 1/0401 |
| 2020/0041012 | A1 * | 2/2020 | Chang | E03C 1/025 |
| 2020/0102724 | A1 * | 4/2020 | Rosko | E03C 1/0403 |
| 2020/0392706 | A1 * | 12/2020 | Hunziker | E03C 1/0401 |
| 2021/0087799 | A1 * | 3/2021 | Wei | E03C 1/0402 |

* cited by examiner

*Primary Examiner* — J C Jacyna
(74) *Attorney, Agent, or Firm* — JCIP Global Inc.

(57) ABSTRACT

An on-basin installation device of a faucet is provided, wherein a basin surface is disposed with an installation hole. The device includes an installation seat, for installing the faucet above the basin surface and disposed with a limiting hole; a fastener, disposed with a first connection hole and a second connection hole; a driving member, disposed with a driving part at one end thereof, wherein the driving part abuts to a top surface of the installation seat, another end thereof passes through the limiting hole and the installation hole to extend below the basin surface, and a portion thereof extending below the basin surface penetrates the first connection hole and is screwed with the first connection hole; and an anti-rotation member, with one end thereof fixed to the installation seat and another end thereof penetrating the second connection hole and abutting to a side wall of the second connection hole.

10 Claims, 2 Drawing Sheets

ON-BASIN INSTALLATION DEVICE OF FAUCET

CROSS-REFERENCE TO RELATED APPLICATION

This application claims the priority benefit of China application serial no. 202020548084.3, filed on Apr. 14, 2020. The entirety of the above-mentioned patent application is hereby incorporated by reference herein and made a part of this specification.

BACKGROUND

Technical Field

The disclosure relates to the field of faucets, and in particular to an on-basin installation device of a faucet.

Description of Related Art

In the prior art, for the installation method of fixing a faucet to a washbasin or sink, the installation is mostly performed below the washbasin or sink. The disadvantage of a below-basin installation method is that the operator needs to bend into the narrow space below the washbasin or sink to perform the installation operation, so the installation operation is difficult. Also, since the pipes disposed below the washbasin or sink may easily block the line of sight and limit the continuous use of tools such as a wrench, which is also inconvenient for installation.

In addition, most of the existing on-basin installation devices have complicated structures and intricate parts. If any part fails, the installation device cannot be used normally, so the practicability is poor. The conventional installation structure of the sleeve body cannot be adapted to different types of faucets, which limits the number or thickness of the faucet connection pipes, and cannot meet the actual usage requirements.

SUMMARY

The disclosure provides an on-basin installation device of a faucet to overcome the defects in the prior art. The device is suitable for on-basin installation, has a simple structure to facilitate operation, and is adapted to different types of faucets, so as to meet the actual usage requirements.

To achieve the above objectives, the disclosure adopts the following technical solutions:

An on-basin installation device of a faucet, wherein the basin surface is disposed with an installation hole, which includes: an installation seat, for installing the faucet on the basin surface and disposed with a limiting hole thereon; a fastener, disposed with a first connection hole and a second connection hole; a driving member, disposed with a driving part at one end thereof, wherein the driving part abuts to a top surface of the installation seat, another end thereof passes through the limiting hole and the installation hole to extend below the basin surface, and the portion thereof extending below the basin surface penetrates the first connection hole and is screwed with the first connection hole; an anti-rotation member, one end thereof is fixed to the installation seat, and another end thereof penetrates the second connection hole and abuts to a side wall of the second connection hole to prevent the fastener from rotating relative to the installation seat.

Preferably, a bottom part of the installation seat extends toward the fastener to form a positioning boss, and the positioning boss abuts to a hole wall of the installation hole for positioning.

Preferably, a soft gasket is also included, a shape thereof is adapted to the fastener, the soft gasket is disposed above the fastener, and abuts to the basin surface and the fastener when the fastener is tightly locked.

Preferably, the fastener is a plate structure with a width in at least one direction less than a width of the installation hole, and a width in at least another direction greater than the width of the installation hole.

Preferably, the driving member is a screw configured with a head part, and the head part constitutes the driving part.

Preferably, the anti-rotation member is a pin, the installation seat is disposed with a fixing hole; one end of the pin extends into the fixing hole to be fixed to the installation seat, and another end thereof penetrates the second connection hole.

Preferably, an installation conversion head is further included, the installation seat is fixed in the installation conversion head, and the faucet is sleeved and fixed outside the installation conversion head.

It can be known from the above descriptions of the disclosure that, compared with the prior art, the disclosure has the following beneficial effects:

1. The device is suitable for an on-basin installation, requires few accessories, and the assembly relationship between the accessories is simple and easy to implement, which is convenient for the actual installation of the operator. Specifically, the function of each accessory of the device is:

The installation seat is configured to install the faucet on the basin surface and keep the faucet to remain in the centre. The limiting hole disposed thereon is configured to assemble the driving member.

One end of the driving member is disposed with the driving part abutting to the top surface of the installation seat, another end thereof passes through the limiting hole and the installation hole to extend below the basin surface, and the portion thereof extending below the basin surface penetrates the first connection hole of the fastener and is screwed with the first connection hole. Therefore, it is convenient for the operator to perform the rotation operation on the driving part within the line of sight above the basin surface to drive the fastener to move up and down relative to the driving member. When the fastener is driven to move up until tightly abutting to the basin surface, the fastener may cooperate with the installation seat to lock the basin surface, so that the faucet is stably installed on the basin surface and is not easily shaken. When the fastener is driven to move down away from the basin surface, the faucet may be easily removed.

One end of the anti-rotation member is fixed to the installation seat, and another end thereof penetrates the second connection hole of the fastener and abuts to the side wall. Therefore, when the fastener moves up and down relative to the driving member, the anti-rotation member may effectively prevent the fastener from rotating relative to the installation seat, so that the fastener may only move up and down relative to the installation seat, and cannot rotate in the circumferential direction, so as to implement the on-basin installation.

Since the installation seat and the fastener may be stably connected by only the driving member and the anti-rotation member, the sizes of the driving member and the anti-rotation member may be reduced without affecting the installation effect, so as to increase the space of both the installation seat and the fastener configured to accommodate the faucet water pipe. That is, the space may accommodate the faucet water pipe with a greater quantity or a greater diameter, which is universally adapted to the actual installation requirements of different types of faucets. Moreover, since the length of the portion of the driving member extending into the basin surface limits the distance that the fastener may move up and down, driving members with different thread lengths can be adapted to basin surfaces of different thicknesses for the locking operation, which is strongly adaptable and easy to implement.

Preferably, the anti-rotation member may be detachably fixed on the installation seat. That is, after the installation is completed, the anti-rotation member may be detached from the installation seat for recycling use. If the faucet needs to be detached, the anti-rotation member may be reinstalled on the installation seat and the fastener to be used normally.

2. The bottom part of the installation seat extends toward the fastener to form the positioning boss, and the positioning boss abuts to the hole wall of the installation hole to determine the relative position of the installation seat and the installation hole, so as to ensure that after the fastener and the installation seat cooperate to lock the basin surface tightly, the installation seat may completely cover the installation hole to prevent the installation hole from being exposed, so as to improve the completeness and aesthetics of the entire installation.

3. When the fastener locks tightly the basin surface, the top and bottom surfaces of the soft gasket abut to the bottom surface of the basin surface and the fastener respectively to prevent skidding while the fastener locks the basin surface tightly, so as to ensure that the faucet is not easy to loosen after installation.

4. The fastener is the plate structure with the width in at least one direction less than the width of the installation hole, and the width in at least another direction greater than the width of the installation hole. Therefore, by tilting the fastener with the plate structure at different angles, the fastener may be easily inserted into the installation hole through a portion of the fastener with the width less than the width of the installation hole for the locking operation. After being inserted into the installation hole, since the width of a portion of the fastener is greater than the width of the installation hole, the fastener is prevented from being detached from the installation hole, so as to further ensure the stability of the installation.

5. The driving member is the screw configured with the head part, and the head part is generally disposed as a hexagon. That is, the operator may rotate the head part with a conventional wrench, thereby driving the screw to rotate, which is suitable for conventional installation tools.

6. The anti-rotation part is the pin, and a head part thereof is mostly configured with a line or cross pattern, which may be stably fixed to the installation seat with conventional tools, and may be easily removed after the installation is completed.

7. Since the installation seat is fixed to the faucet through the installation conversion head, the installation seat may be adapted to be installed with different types of faucets by replacing different types of installation conversion heads.

BRIEF DESCRIPTION OF THE DRAWINGS

In order to more clearly explain the technical solution of the embodiments of the disclosure, the following briefly introduces the drawings required in the descriptions of the embodiments. Obviously, the drawings in the following descriptions are some embodiments of the disclosure, and persons skilled in the art may obtain other drawings based on these drawings without any inventive effort.

DETAILED DESCRIPTION OF DISCLOSED EMBODIMENTS

Figure 1:
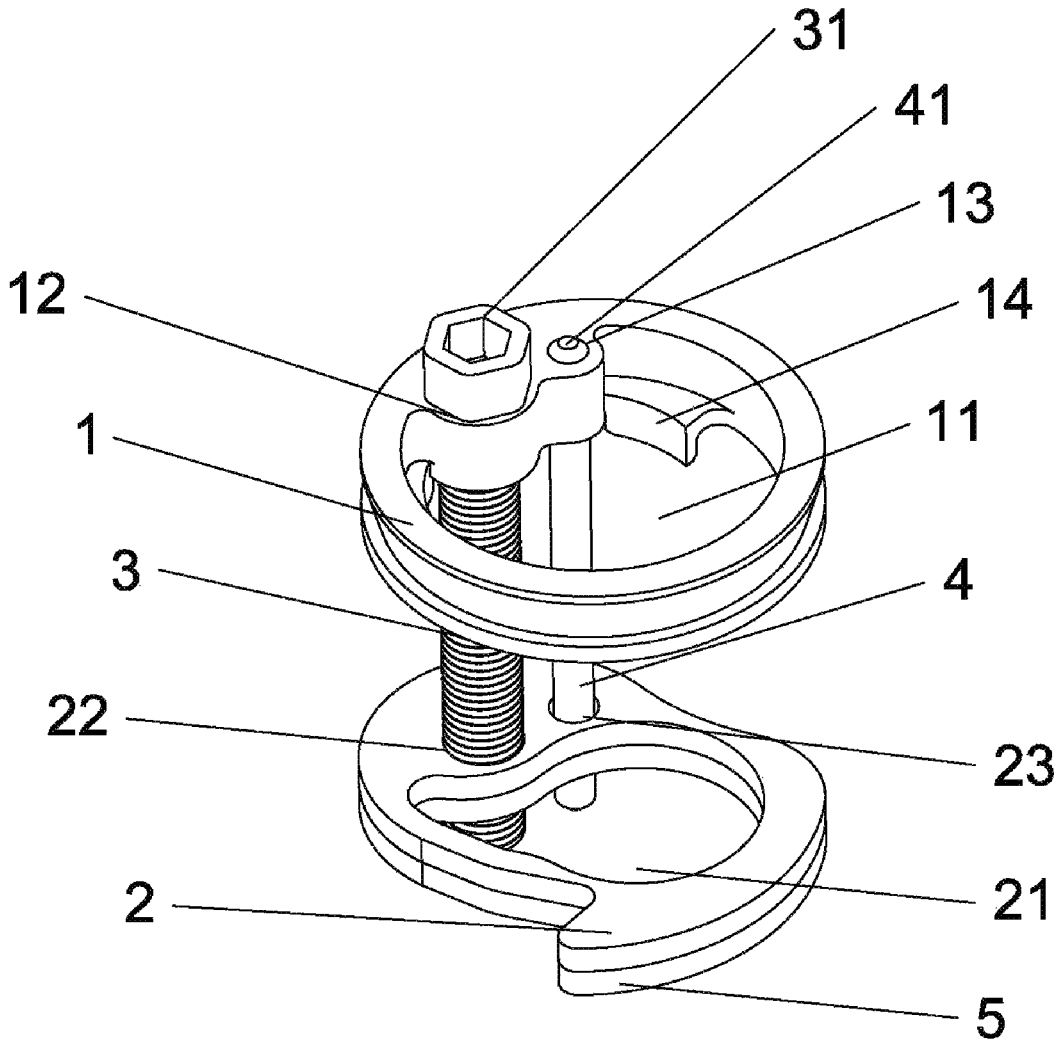
FIG. 1 is a schematic view of a structure of an on-basin installation device according to an embodiment of the disclosure.

The technical solution in the embodiments of the disclosure will be described clearly and completely in conjunction with the drawings in the embodiments of the disclosure. Obviously, the described embodiments are the preferred embodiments of the disclosure, and should not be regarded as the exclusion of other embodiments. Based on the embodiments of the disclosure, all other embodiments obtained by persons skilled in the art without any inventive effort fall within the protection scope of the disclosure.

In the claims, specification, and drawings of the disclosure, unless clearly defined otherwise, terms such as "first", "second", or "third" are used to distinguish different objects, instead of describing a specific sequence.

In the claims, specification, and drawings of the disclosure, unless clearly defined otherwise, using directional terms such as "center", "horizontal", "vertical", "parallel", "perpendicular", "top", "bottom", "inner", "outer", "above", "below", "front", "back", "left", "right", "clockwise", "counterclockwise", etc. to instruct orientation or positional relationship is based on the orientation and positional relationship shown in the drawings, and is only for the convenience of describing the invention and simplifying the description, rather than instructing or implying that the device or element referred to must have a specific orientation or be constructed and operated in a specific orientation, so it should not be understood as limiting the specific protection scope of the disclosure.

In the claims, specification, and drawings of the disclosure, unless clearly defined otherwise, if the terms "fixed to" or "fixedly connected to" are used, it should be understood in a broad sense. That is, it should be understood that the two may be connected in any manner without displacement relationship and relative rotational relationship. In other words, the connection includes a non-detachable fixed connection, a detachable fixed connection, an integrated connection, and a fixed connection through other devices or elements.

In the claims, specification, and drawings of the disclosure, the terms "including", "having", and variations thereof are intended to "include, but not limited to".

Figure 2:
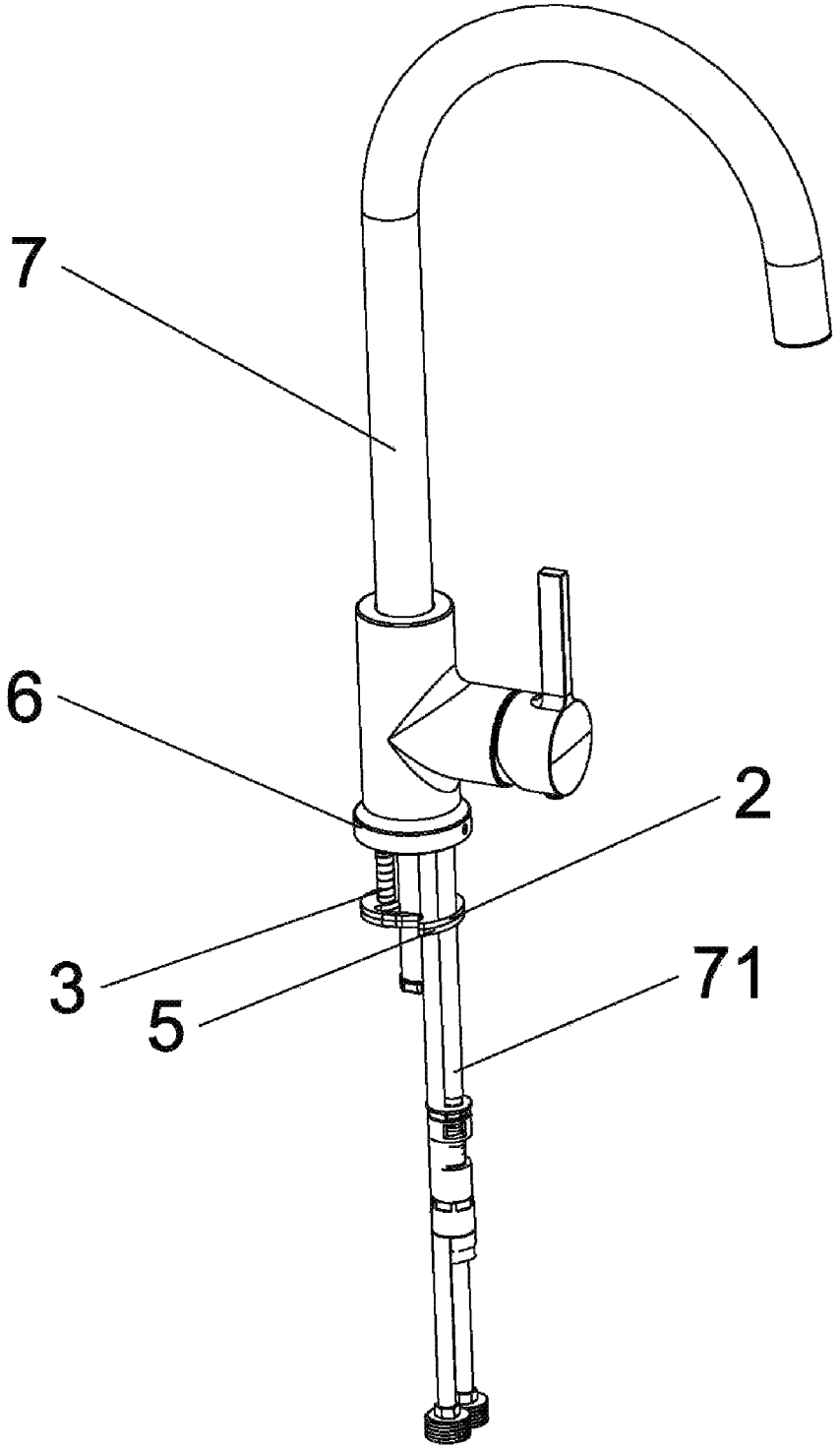
FIG. 2 is a schematic view of an assembly of an on-basin installation device and a faucet according to an embodiment of the disclosure.

Referring to FIG. 1 and FIG. 2, FIG. 1 shows a structure of an on-basin installation device in the embodiment of the disclosure. The on-basin installation device is configured to install and fix a faucet on a basin surface, wherein a faucet 7 is generally connected with multiple faucet water pipes 71. The basin surface is disposed with installation holes. The on-basin installation device includes an installation seat 1, a fastener 2, a driving member 3, an anti-rotation member 4, a soft gasket 5, and an installation conversion head 6.

The installation seat 1 is configured to install the faucet 7 on the basin surface and keep the faucet 7 to remain in the centre. A first water pipe through-hole 11 is formed by hollowing out from the top surface of the installation seat 1 for the faucet water pipe 71 to extend into. The circumference of the first water pipe through-hole 11 is an arc to prevent friction with the faucet water pipe 71. In addition, a limiting hole 12 and a fixing hole 13 extending along the direction of the axis of the installation seat 1 are disposed in the non-hollow portion thereof. The limiting hole 12 is configured to connect the driving member 3 and the fixing hole 13 is configured to connect the anti-rotation member 4. Also, in the embodiment, the fixing hole 13 is configured with a screw thread. The bottom part of the installation seat 1 extends downward to form symmetrical positioning bosses 14. Each positioning boss 14 is an arc, which is configured to adapt to the shape of the installation hole, so as to smoothly abut to the hole wall of the installation hole of the basin surface for positioning. In the embodiment, the installation seat 1 is configured as a circular shape, which may completely cover the installation hole of the basin surface.

A second water pipe through-hole 12 is formed by hollowing out from the top surface of the fastener 2, which is also for the faucet water pipe 71 to extend into. The second water pipe through-hole 12 is hetero-shaped to facilitate the dispersed arrangement of each faucet water pipe 71. In addition, a first connection hole 22 and a second connection hole 23 are disposed in the non-hollow portion of the fastener 2. The first connection hole 22 is configured to connect the driving member 3 and the second connection hole 23 is configured to connect the anti-rotation member 4.

In the embodiment, the fastener 2 is a plate structure with the width in at least one direction less than the width of the installation hole, and the width in at least another direction greater than the width of the installation hole.

One end of the driving member 3 is disposed with a driving part 31. The width of the driving part 31 is greater than the aperture of the limiting hole 12, for the driving part 31 thereof to abut to the top surface of the installation seat 1 after one end of the driving member 3 passes through the limiting hole 12. In the embodiment, the driving member 3 is a screw configured with a head part. The hexagonal head part constitutes the driving part 31, and the shaft portion is provided with a thread, which is convenient for the operator to rotate the head part with a conventional wrench to drive the shaft to rotate.

In the embodiment, the anti-rotation member 4 is a pin, and the head part thereof constitutes a fixing part 41. The head part thereof is mostly disposed with a line or cross pattern, and the shaft thereof is disposed with an external thread adapted to an internal thread of the fixing part 41.

The shape of the soft gasket 5 is adapted to the fastener 2 and is disposed with the same hole and through-hole as the fastener 2. The soft gasket 5 is disposed above the fastener 2.

The installation conversion head 6 is configured as a hollow tube with the inner diameter adapted to the installation seat 1, so that the installation seat 1 could be fixed inside the installation conversion head 6. The outer wall of the installation conversion head 6 is configured with a thread to be screwed and fixed to the faucet 7. The installation seat 1 can be adapted to different types of faucets by cooperating with different types of installation conversion heads.

As shown in FIG. 2, in the embodiment, the assembly relationship of the on-basin installation device is as follows:

After one end of the driving member 3 passes through the limiting hole 12 of the installation seat 1, the one end sequentially penetrates the soft gasket 5 and the first connection hole 22 of the fastener 2, and is screwed with the first connection hole 22. The driving part 31 is disposed at another end of the driving member 3 and abuts to the top surface of the installation seat 1. In the embodiment, the anti-rotation member 4 is arranged parallel to the driving member 3, that is, one end of the anti-rotation member 4 extends into the fixing hole 13 of the installation seat 1, and is screwed with the fixing hole 13, so that one end of the anti-rotation member 4 is fixed to the installation seat 1. Another end of the anti-rotation member 4 extends toward the fastener 2, penetrates the second connection hole 23 of the fastener 2, and abuts onto the side wall of the second connection hole 23 to prevent the fastener 2 from rotating relative to the installation seat 1. That is, after the installation seat 1, the fastener 2, and the soft gasket 5 are correspondingly connected through the driving member 3 and the anti-rotation member 4, each accessory is assembled to form an entire device.

Then, the entire device is installed onto the basin surface for the subsequent locking operation. Specifically, the installation seat 1 is covered above the installation hole of the basin surface, so that the positioning boss 14 at the bottom of the installation seat 1 abuts to the hole wall of the installation hole. The positioning boss 14 may determine the relative position of the installation seat 1 and the installation hole of the basin surface. After tilting the soft gasket 5 and the fastener 2 connected with the driving member 3 and the anti-rotation member 4 at a certain angle, the soft gasket 5 and the fastener 2 are inserted into the installation hole by virtue of the portion with the width less than that of the installation hole to extend below the basin surface, so that both the soft gasket 5 and the fastener 2 are horizontally placed under the basin surface, and the soft gasket 5 is disposed above the fastener 2.

After the entire device is stably installed, that is, one end of the driving member 3 passes through the limiting hole 12 and the installation hole to extend below the basin surface, and the portion of the driving member 3 extending below the basin surface penetrates the first connection hole 22 and is screwed with the first connection hole 22. The driving part 31 disposed at another end of the driving member 3 stably abuts to the top surface of the installation seat 1. One end of the anti-rotation member 4 penetrates the second connection hole 23 and abuts to the side wall of the second connection hole 23, so as to prevent the fastener 2 from rotating relative to the installation seat 1. Another end is fixed to the installation seat 1.

Both the settings of the driving member 3 penetrating the first connection hole 22 and the anti-rotation member 4 penetrating the second connection hole 23 are configured to ensure that the driving member 3 and the anti-rotation member 4 can be stably connected to the fastener 2 to prevent connection skewing from happening during the placement and installation process, so as to ensure the normal usage of the entire installation device.

Then, the operator only needs to use a conventional wrench to rotate the driving part 31 above the basin surface. That is, the driving member 3 may be rotated to drive the fastener 2. Since the anti-rotation member 4 prevents the fastener 2 from rotating relative to the installation seat 1, after being driven by the driving member 3, the fastener 2 may only move up and down relative to the driving member 3 to move close to or away from the basin surface. When the fastener 2 moves upward until tightly abutting to the soft gasket 5 and when the soft gasket 5 tightly abuts to the bottom surface of the basin surface, the locking operation is completed. That is, skidding is prevented through the soft gasket 5 when the fastener 2 is tightly locked to the basin surface, such that the installation seat 1 and the fastener 2 can tightly clamp the basin surface for performing the subsequent installation of the faucet 7.

Since the width of the fastener 2 in at least another direction is greater than the width of the installation hole, the portion with the width greater than the width of the installation hole prevents the fastener 2 from being detached from the installation hole to further ensure the stability of the installation. Further, the thread length of the driving member 3 limits the distance that the fastener 2 may move up and down relative to the driving member 3. Therefore, through replacing the driving member 3 with different thread lengths, it is possible to adapt to basin surfaces of different thicknesses for the locking operation, which is strongly adaptable and easy to implement. Moreover, since the anti-rotation member 4 and the installation seat 1 are detachably connected, after the locking operation is completed, the fixing part 41 of the anti-rotation member 4 may be rotated by a conventional screwdriver to detach the anti-rotation member 4 from the installation seat 1 for recycling use. If the anti-rotation member 4 needs to be used, the same is reassembled to the installation seat 1 and the fastener 2 for normal usage.

Then, the installation conversion head 6 is sleeved outside the installation seat 1 and is fixed to the installation seat 1 through a fastener. Then, the faucet 7 is sleeved outside the installation conversion head 6 and is screwed with the installation conversion head 6 to implement the stable connection between the faucet 7, the installation conversion head 6, and the installation seat 1, so that the faucet 7 may always remain in the centre after installation, thus facilitating practical use. The faucet water pipe 71 of the faucet 7 penetrates the installation hole of the basin surface via the first water pipe through-hole 11 of the installation seat 1 to extend below the basin surface, and extends out via the second water pipe through-hole 11 of the fastener 2 after passing through the soft gasket 5.

Since the device is correspondingly connected to the installation seat 1 and the fastener 2 through the fastener 3 and the anti-rotation member 4, the stable assembly relationship between each accessory can be achieved, and the assembly relationship is simple without the need to provide redundant connection accessories. That is, the space required by the installation seat 1 and the fastener 2 is small. Therefore, compared with the conventional sleeve structure, the space for the installation seat 1 and the fastener 2 to accommodate the faucet water pipe 71 is expanded. That is, the space for the first water pipe through-hole 11 and the second water pipe through-hole 21 is expanded to accommodate the faucet water pipe 71 with a greater quantity or a thicker pipe, which is adapted to the actual installation requirements of different types of faucets 7.

When the faucet 1 needs to be disassembled, the operator reversely rotates the driving part 31 with a wrench to drive the fastener 2 to move downward to move away the basin surface, so the disassembly operation is quick and easy.

Preferably, of course, it is also applicable to the assembly method in which the faucet 7 is directly installed onto the on-basin installation device, and then integrally assembled to the basin surface. The assembly method does not affect the installation effect thereof. Also, since the installation seat 1 under heavy weight may more smoothly and tightly abut to the top surface of the basin surface, the installation effect is better.

In summary, the on-basin installation device provided by the embodiments is suitable for on-basin installation, has a simple structure to facilitate operation, and is universally adapted to different types of faucets, which can meet the actual usage requirements.

The descriptions of the specification and embodiments are used to explain the protection scope of the disclosure, but do not limit the protection scope of the disclosure. Through the motivation of the disclosure or the embodiments, persons skilled in the art may obtain modifications, equivalent replacements, or other improvements of the embodiments or part of the technical features of the disclosure through logical analysis, reasoning, or limited experiments combined with common knowledge, common technical knowledge in the art, and/or prior art, which should all be included in the protection scope of the disclosure.

What is claimed is:

1. An on-basin installation device of a faucet, wherein a basin surface is disposed with an installation hole, comprising:

an installation seat, for installing the faucet above the basin surface and disposed with a limiting hole thereon;

a fastener, disposed with a first connection hole, a second connection hole, and a through-hole, wherein the through-hole is formed by hollowing the fastener and is for the faucet to extend into;

a driving member, disposed with a driving part at one end thereof, wherein the driving part abuts to a top surface of the installation seat, another end thereof passes through the limiting hole and the installation hole to extend below the basin surface, and a portion thereof extending below the basin surface penetrates the first connection hole and is screwed with the first connection hole; and an anti-rotation member, with one end thereof fixed to the installation seat and another end thereof penetrating the second connection hole and abutting to a side wall of the second connection hole to prevent the fastener from rotating relative to the installation seat, wherein the anti-rotation member is a pin, the installation seat is disposed with a fixing hole, one end of the pin extends into the fixing hole to be fixed to the installation seat, and another end thereof penetrates the second connection hole.

2. The on-basin installation device of a faucet according to claim 1, wherein a bottom part of the installation seat extends toward the fastener to form a positioning boss, and the positioning boss abuts to a hole wall of the installation hole for positioning.

3. The on-basin installation device of a faucet according to claim 1, further comprising: a soft gasket, wherein a shape of the soft gasket is adapted to the fastener, the soft gasket is disposed above the fastener, and the soft gasket abuts to the basin surface and the fastener when the fastener is tightly locked.

4. The on-basin installation device of a faucet according to claim 1, wherein the fastener is a plate structure, a width thereof in at least one direction is less than a width of the installation hole, and the width thereof in at least another direction is greater than the width of the installation hole.

5. The on-basin installation device of a faucet according to claim 1, wherein the driving member is a screw configured with a head part, and the head part constitutes the driving part.

6. The on-basin installation device of a faucet according to claim 1, further comprising: an installation conversion head, wherein the installation seat is fixed in the installation conversion head, and the faucet is sleeved and fixed outside the installation conversion head.

7. The on-basin installation device of a faucet according to claim 2, further comprising: an installation conversion head, wherein the installation seat is fixed in the installation conversion head, and the faucet is sleeved and fixed outside the installation conversion head.

8. The on-basin installation device of a faucet according to claim 3, further comprising: an installation conversion head, wherein the installation seat is fixed in the installation conversion head, and the faucet is sleeved and fixed outside the installation conversion head.

9. The on-basin installation device of a faucet according to claim 4, further comprising: an installation conversion head, wherein the installation seat is fixed in the installation conversion head, and the faucet is sleeved and fixed outside the installation conversion head.

10. The on-basin installation device of a faucet according to claim 5, further comprising: an installation conversion head, wherein the installation seat is fixed in the installation conversion head, and the faucet is sleeved and fixed outside the installation conversion head.

* * * * *